US006786306B2

(12) United States Patent
Tiner

(10) Patent No.: US 6,786,306 B2
(45) Date of Patent: Sep. 7, 2004

(54) ELEVATOR MECHANISM

(76) Inventor: James L. Tiner, 16205 Old US 41, Fort Myers, FL (US) 33912

( * ) Notice: Subject to any disclaimer, the term of this patent is extended or adjusted under 35 U.S.C. 154(b) by 70 days.

(21) Appl. No.: 10/123,216

(22) Filed: Apr. 17, 2002

(65) Prior Publication Data

US 2003/0196857 A1 Oct. 23, 2003

(51) Int. Cl.[7] ..... B66B 7/10
(52) U.S. Cl. ..... 187/413; 187/266; 187/270
(58) Field of Search ..... 187/266, 270, 187/412, 413, 264

(56) References Cited

U.S. PATENT DOCUMENTS

| | | | | | |
|---|---|---|---|---|---|
| 1,066,052 | A | * | 7/1913 | Ritter | 187/266 |
| 1,810,960 | A | * | 6/1931 | Hall | 187/413 |
| 1,864,093 | A | * | 6/1932 | Price | 187/413 |
| 2,017,372 | A | | 10/1935 | Morrison | |
| 3,295,832 | A | | 1/1967 | Fowler | |
| 3,344,888 | A | | 10/1967 | Connelly et al. | |
| 3,430,733 | A | * | 3/1969 | Smith | 187/413 |
| 3,662,862 | A | | 5/1972 | Poller | |
| 3,665,270 | A | | 5/1972 | Ayers | |
| 3,885,773 | A | | 5/1975 | Dunkelberger | |
| 4,058,186 | A | | 11/1977 | Mullis | |
| 5,086,880 | A | * | 2/1992 | Pearce | 187/413 |
| 5,398,781 | A | | 3/1995 | Biewald et al. | |

FOREIGN PATENT DOCUMENTS

| | | | | |
|---|---|---|---|---|
| GB | 1559460 | | 1/1980 | |
| JP | 3-13478 A | * | 1/1991 | 187/413 |
| JP | 3-26681 A | * | 5/1991 | 187/413 |
| JP | 06-321457 | | 11/1994 | |
| JP | 10-182034 | | 7/1998 | |

* cited by examiner

*Primary Examiner*—Eileen D. Lillis
*Assistant Examiner*—Thuy V. Tran
(74) *Attorney, Agent, or Firm*—Richard C. Litman

(57) ABSTRACT

An elevator mechanism protects the control, communications, power, and/or lift cable(s) of the elevator system, precluding lateral cable movement within the elevator shaft. A slotted cable guide contains a cable therein, with the cable having a diameter larger than the guide slot to preclude escape of the cable from the guide. The upper end of the cable has a reduced diameter and extends through the guide slot, where it is supported by a lift bar extending from the elevator car and into the slot. A mechanism allows the lift bar to move laterally to preclude binding in the guide if the elevator car shifts laterally slightly. Another mechanism shuts down the system if the cable and/or cable reel jams. The present elevator mechanism is adaptable to virtually any type of elevator and lift mechanism, but is particularly useful with elevators used in tall, open structures.

18 Claims, 8 Drawing Sheets

ELEVATOR MECHANISM

BACKGROUND OF THE INVENTION

1. Field of the Invention

The present invention relates generally to elevator control mechanisms, and more specifically to a cable guide for retaining the control, communication, power, and other cables extending from the base of the structure to the elevator car (commonly called "trailing cables"). The present guide may be used with virtually any elevator structure, but is particularly useful with elevators of tall latticework structures (e.g., tall television antenna towers) where the trailing cable would otherwise be subject to deflection by the wind. The present invention provides secure cable management for elevators operated by hard wired, direct connection cables.

2. Description of the Related Art

Elevator cables in relatively low structures conventionally comprise hard wired trailing cables extending between the base of the elevator structure and the elevator car. These elevator systems can be either cable hoisted or rack and pinion driven. However, with the development of taller structures, the use of cable hoisted systems became the only feasible system, since there was no way to manage the trailing cables on tall structures.

Since trailing cables could not be used, these elevator systems turned to the use of wireless radio systems to transmit control and communication between the base of the elevator structure and the elevator car. Obviously, if no trailing cable could be used, there could be no means of getting power to an elevator car, such as is needed for a rack and pinion system. Consequently, no rack and pinion systems using a trailing cable can be used on these tall lattice structures. (The present inventor knows of one system which uses a gas driven generator to provide power to the drive motor on a rack and pinion system. However, this has not become widely used or popular, for obvious safety reasons.)

This has particularly been the case with elevators used in tall open (latticework) structures, such as television antenna towers and the like, which may extend to well over one thousand feet above the surface. Obviously, some form of elevator, and accompanying lift and control systems, are virtually essential for workers and maintenance crews to travel to the top of the tower. In such open structures, any cables (lift, control, power and communication, etc.) which extend between the base of the elevator shaft and the elevator car, are exposed to the wind, and are subject to being blown against the structure with some accompanying risk of damage. Accordingly, nearly all such structures use a wireless radio link between the elevator car and the base for control. Wireless is used because there currently is no system available for hard wiring a positive circuit for these elevator systems.

These wireless radio controlled systems are subject to interference from outside transmissions and frequency shift, thus diminishing their reliability. The interference risk increases as the elevator and tower height increases, due to the greater line of sight range to the horizon with increasing height. Moreover, while the transceiver at the base may have a reliable power source, the transceiver in the elevator car must be powered by batteries, with the accompanying possibility of low battery power disabling the system. These are serious safety concerns associated with a wireless control system which are eliminated by the present invention.

The present invention provides a solution by providing a means for protecting a hard wired trailing cable in an elevator system. The present invention includes a cable guide in which the power, control, and communication cable(s) is/are routed through a guide which restrains the cable(s) and protects the cable(s) from the wind or other force(s) which might otherwise cause the cable(s) to come in contact with the structure. The present cable guide may also be used to contain a conventional lift cable mechanism for an elevator, in addition to or in lieu of its use for containing communications and/or control cables. The present cable guide system also includes means for precluding jamming or breaking of the cable, in the event the takeup system malfunctions or the cable jams in some manner.

A discussion of the related art of which the present inventor is aware, and its differences and distinctions from the present invention, is provided below.

U.S. Pat. No. 2,017,372 issued on Oct. 15, 1935 to James J. Morrison, titled "Guideway," describes a device for holding control cables within a guideway immediately adjacent the elevator car, to preclude their moving outwardly from the guideway and coming into contact with the car. Morrison recognizes the problem of the relatively slack control and/or communication cables moving laterally within the elevator shaft (or "hatch," as he calls it). However, the Morrison guideway system allows the cable to pass therefrom at any point, and Morrison requires a roller at the bottom of the elevator car to bear against the cable within the guideway, to hold the cable within the guideway only at that point in order to preclude escape of the cable from the guideway at that point and possible contact with and damage due to the moving elevator car. Morrison does nothing to retain the cable within the guide at other locations along the guide. In contrast, the present system retains the cable within the guide at all points except immediately adjacent to the car, where the cable bundle narrows to pass through the gap in the side of the guide. This is possible because the cable moves within the guide in the present system, whereas the cable is relatively stationary (excepting the moving loop) in the Morrison system. In the Morrison system, the slot or gap in the side of the guide must be sufficiently large to allow the cable bundle to pass therethrough at any location therealong, whereas the present guide need only have a slot sufficiently wide to allow the smaller end of the cable to pass therethrough.

U.S. Pat. No. 3,295,832 issued on Jan. 3, 1967 to John H. Fowler, titled "Cable Guide Means," describes a relatively short guide having a longitudinal slot therein sufficiently wide for a cable contained therein, to pass therethrough. A conical or funnel-shaped component is attached to each end, with the funnel ends also having lateral cable passage slots therethrough. The slots of the funnel ends are turned so they are not in registry with the slot of the guide, thereby holding the cable within the guide. The Fowler device thus teaches away from the present invention, as the cable cannot pass through the wall of the guide at all, but can only pass from either end of the Fowler guide.

U.S. Pat. No. 3,344,888 issued on Oct. 3, 1967 to Edward J. Connelly et al., titled "Elevator Car, Its Machine Room, And An Elevator Traveling Cable Including Both Electrical And Fluid Conductors Connected Therebetween," describes a cable construction and suspension means in which a plurality of cable casing strands or wires are secured to an anchor to support the cable. No cable guide is disclosed.

U.S. Pat. No. 3,662,862 issued on May 16, 1972 to Harry S. Poller, titled "Guide Rope Stabilizer," describes pairs of flexible shoes which secure a guide rope within a guide channel attached to an elevator car. The shoes or stabilizers can flex out of the way when the car moves upwardly or downwardly in the shaft, as the guide channel encounters a fixed guide along the guide rope. The guide ropes in the operating environment of the Poller device are fixed at each end, and do not move, as do the cables in the elevator mechanism of the present invention. The elevator car in the Poller system moves upwardly and downwardly along the fixed guide ropes, with the guide channel being affixed to the elevator car and the guide ropes being fixed relative to the elevator shaft. This is generally opposite the present system, where the guide is fixed to the elevator shaft and the cable(s) move(s) upwardly and downwardly within the fixed guide. Poller does not provide any means for his guide ropes to exit a guide and attach to the elevator car, as the guide ropes of the Poller system do not attach directly to the car nor do they provide any form of electrical control or communication power or signal to the car.

U.S. Pat. No. 3,665,270 issued on May 23, 1972 to Peter J. H. Ayers, titled "Electric Transducers For Tension Control In A Winding Device," describes a transducer mechanism incorporating a "dancer arm" which rides upon the filament or web sheet being wound. The arm communicates with an electromechanical mechanism which in turn increases tension in the filament or web as slack forms, and decreases tension as slack decreases. The Ayers '270 transducer disclosure is incorporated herein by reference, as exemplary of such transducer means. The present elevator mechanism may use a similar transducer mechanism driven by the movement of an idler pulley around which the cable is wrapped, to act as a slack cable control in the cable takeup and feed reel for the system.

U.S. Pat. No. 3,885,773 issued on May 27, 1975 to Thomas L. Dunkelberger, titled "Magnetic Cable Takeup Device," describes a system much like that described in the Morrison '372 U.S. Pat. No. , discussed further above. However, Dunkelberger provides a series of magnets along the cable guide, with a series of magnetically attractive bands or the like being attached to the cable(s). The magnets hold the cable(s) within the guide due to the magnetic attachments to the cable(s). Otherwise, the Dunkelberger system is similar to that of the system of the Morrison '372 U.S. Pat. No. , with a roller extending from the elevator car and bearing against the cable(s) within the open guide to hold the cable(s) in place adjacent to the elevator car. As in the Morrison system, the cable ends of the Dunkelberger system are fixed, and do not travel in a fixed guide as they do in the case of the present invention.

U.S. Pat. No. 4,058,186 issued on Nov. 15, 1977 to Clyde M. Mollis, titled "Elevator system With Retainer Device For Plurality Of Traveling Cables," describes a retainer which wraps about a single cable, with one end then extending to wrap about one or more adjacent cables to secure the cables together in a single bundle. Mollis does not disclose a cable guide. The Mollis cable is stationary relative to the elevator shaft, and does not move upwardly or downwardly within a guide in the shaft, as does the cable of the present mechanism. If the Mollis cable were to move relative to the shaft or guide, the retainers thereon would likely snag within the shaft, or within the guide, if such were provided.

U.S. Pat. No. 5,398,781 issued on Mar. 21, 1995 to Joachim Bailed et al., titled "Cable Tensioning Device For Elevators," describes different embodiments of a lift cable tensioning device incorporating a rocker, with one end of the lift cable attached to a relatively larger radius arcuate portion of the rocker and the opposite cable end attached to a relatively smaller radius arcuate portion of the rocker. Cable tension varies as the rocker rotates about an arc, as the cable is paid out or drawn in to operate the elevator. The Bailed cable tensioner may be placed with the counterweight, or with the elevator car as desired. However, no cable guide means is disclosed by Bailed et al., nor is any means provided for stopping travel in the event of a cable jam, as provided by the present elevator mechanism invention.

British Patent Publication No. 1,559,460 published on Jan. 16, 1980 to Mitsubishi Denki Kabushiki Kaisha, titled "Elevator Apparatus With A Hanger For Travelling Cable," describes a specific end configuration for the traveling cable (i.e., control and communications cable) in an elevator shaft. The cable of the Mitsubishi disclosure has a central steel structural support member which is surrounded by electrical wiring bundled therewith. It is stated that the cable will have a tendency to twist due to the twist of the individual support cable strands and wrap of the electrical wiring, depending upon the location of the elevator car and thus the relative lengths of the two free ends of the cable. Mitsubishi controls this twist by separating the structural cable and electrical wiring from one another for a predetermined length, allowing the free structural cable end to absorb the cable twist. Mitsubishi does not disclose any form of cable guide, which would provide control of any cable twist which might be developed. Moreover, suspension of the traveling cable of the present elevator mechanism is by means of a grip sleeve around the exterior of the electrical wire bundle, rather than by a central structural support cable, as in the Mitsubishi disclosure.

Japanese Patent Publication No. 6-321,457 published on Nov. 22, 1994 to Hitachi Ltd. describes (according to the drawings and English abstract) a series of rectangular section channels affixed to the walls of an elevator shaft for preventing lateral movement of elevator control cables therein. The Hitachi Patent Publication does not disclose a continuous cable guide for each cable, as provided by the present invention, nor does it disclose any means of retaining the cable within the guide, excepting a relatively short length extending from the guide to the elevator car, as provided by the present elevator mechanism.

Finally, Japanese Patent Publication No. 10-182,034 published on Jul. 7, 1998 to Mitsubishi Electric Corp. describes (according to the drawings and English abstract) a system for moving the junction box of the traveling cable attachment to the elevator shaft wall. This has the benefit of reducing the required length of traveling cable extending from the junction box to the elevator car. However, no cable guide is disclosed in the '034 Japanese Patent Publication, for restraining a cable therein. The movement of the junction box along the elevator shaft wall, would preclude such a cable guide installed along the shaft wall, in any event.

None of the above inventions and patents, taken either singularly or in combination, is seen to describe the instant invention as claimed. Thus an elevator mechanism solving the aforementioned problems is desired.

SUMMARY OF THE INVENTION

The present invention is an elevator mechanism, and more particularly a system for restraining movement of traveling power, control, communications, and/or lift cables in an elevator shaft or structure. The present system includes a continuous guide for the cable, with the cable exiting the guide adjacent to the elevator car and being restrained therein along the remainder of its length.

The present guide includes a continuous slot formed therein, with the cable having a diameter larger than the slot about the majority of the cable length. This precludes passage of the cable through the slot, retaining the cable within the guide except for the narrower end of the cable adjacent the elevator car, where the cable can pass through the slot to extend to the elevator car.

The present invention also includes novel means for suspending the end of the cable adjacent the elevator car, as well as a linear transducer for controlling cable feed and takeup and stop means for shutting down the system in the event of a cable or takeup reel jam. The present cable control system may be used with virtually any type of elevator, but is particularly well suited for use with elevators in relatively tall, open structures such as television transmission antenna towers and the like, where the cable would otherwise be subject to lateral displacement due to wind gusts. The present elevator mechanism allows cable control and communications systems to be used in such structures, rather than relatively unreliable radio control and communication systems with cable hoist systems, and allows the use of rack and pinion systems with the motor being attached directly to the elevator car and powered by the cable in the guide.

Accordingly, it is a principal object of the invention to provide an elevator mechanism for retaining an elevator control, communications, power, and/or lift cable(s) therein, and precluding lateral movement of the cable(s) from the guide.

It is another object of the invention to provide means for supporting the end of the cable adjacent to the elevator car, and for reducing the diameter of the cable at its end to allow the cable to pass through a slot in the wall of the cable guide.

It is a further object of the invention to provide a mechanism for controlling an elevator cable(s) in an elevator shaft which is adaptable to any practicable elevator system, including rack and pinion drives and lift cable drive systems, and which is particularly adaptable for use with elevators used in tall, open latticework structures.

Still another object of the invention is to provide an elevator mechanism including means for stopping the system in the event of a cable or cable reel jam.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an elevator mechanism, and more specifically a mechanism or system for controlling unwanted motion of one or more control, power, communication, and/or lift cables in an elevator shaft. While the present invention may be adapted to virtually any elevator system, it is particularly suitable for use with elevators used in relatively tall, open latticework structures.

Figure 1:
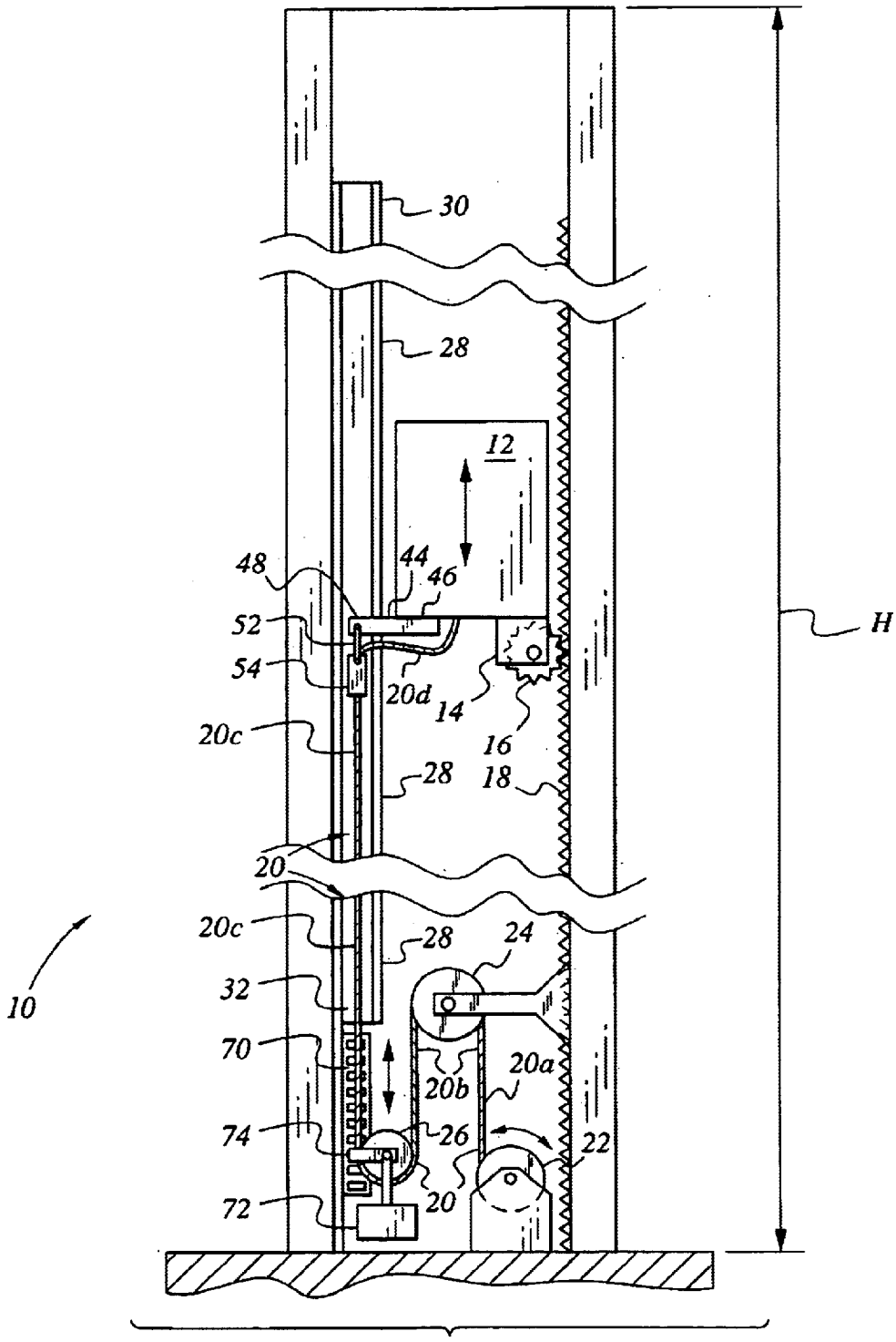
FIG. 1 is an elevation view of a first embodiment comprising a rack and pinion elevator system incorporating the present elevator mechanism, and showing various features thereof.

FIG. 1 illustrates a first embodiment of the present invention installed in an elevator shaft 10. The elevator shaft 10 contains an elevator car 12 which includes a conventional motor 14 which in turn drives a pinion gear or wheel 16. The pinion 16 engages a toothed rack 18 which is secured to the side of the elevator shaft 10. Pinion 16 rotation drives the elevator car 12 upwardly or downwardly in the elevator shaft 10, as is known in the art.

Such systems are conventionally controlled and powered by an elevator cable which carries electrical power to drive the motor 14, as well as wiring for control and/or communication signals. The elevator shaft 10 of FIG. 1 includes such an elevator cable 20, having a first length or segment 20*a* extending from a takeup and dispensing reel 22, around an idler pulley 24 to a second length or segment 20*b* extending to a slack cable buffer control and transducer pulley 26, and around the pulley 26 to extend up the elevator shaft 10 as length or segment 20*c* to connect to and communicate with the elevator car 12.

The problem with the use of a cable for power, control, and/or communications functions of the elevator (and/or using a structural cable to lift the elevator car), is that in very tall structures, the cable(s) is/are subject to lateral motion and can contact portions of the elevator shaft structure, where they can become damaged and/or jam in the structure. This is particularly true in very tall latticework structures which are open to the wind, such as television antenna towers, which is why most such structures utilize radio control systems and cable lift systems.

The present invention provides protection for such cables in the form of a cable guide 28, which extends vertically and continuously for essentially the entire height H of the elevator shaft 10. The upper end 30 of the guide 28 may terminate at a point below the top of the shaft approximately equal to the height of the elevator car 12, while the lower end 32 may terminate slightly above the surface, in order to allow clearance and entry for the cable 20 therein.

Figure 3:
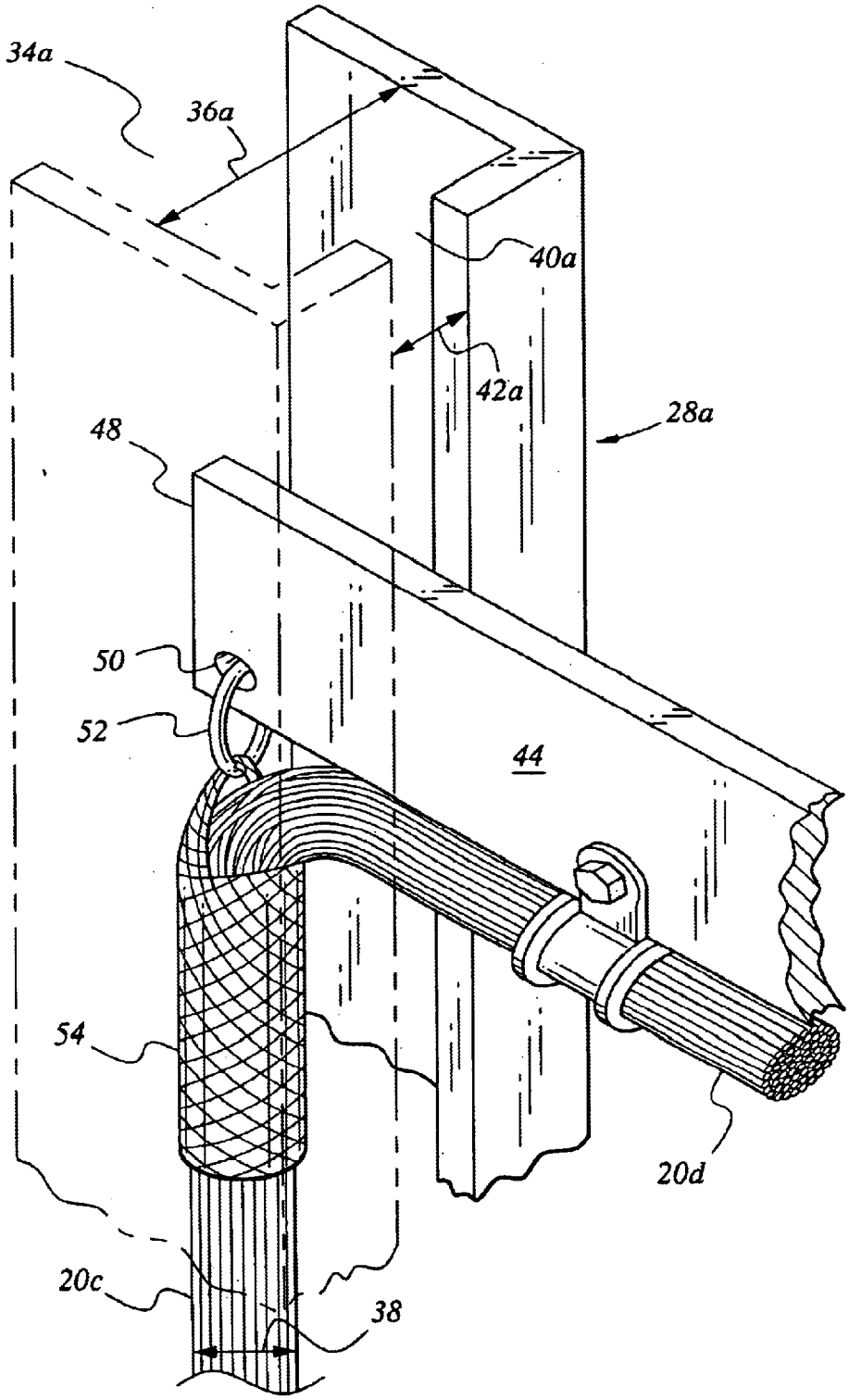
FIG. 3 is a broken away detail perspective view of the upper end of a cable of the present system, showing details of its attachment to a support structure from the elevator car.
Figure 5A:
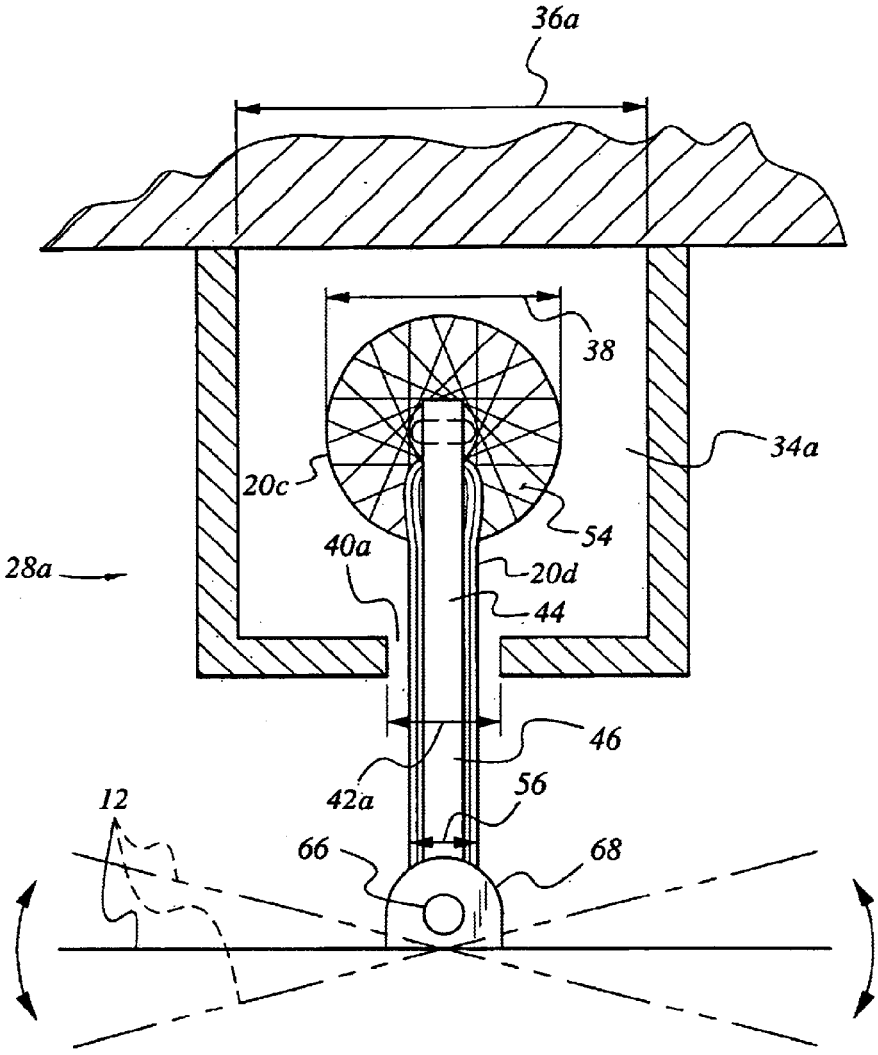
FIG. 5A is a detail top plan view in section, showing a first embodiment cable guide having a square or rectangular section.

FIGS. 3 and 5A illustrate a first embodiment of the present elevator cable guide, designated as guide 28*a*. The present cable guide may have a variety of cross sectional shapes, with the critical feature being the interior dimension which is larger than the diameter of the cable 20 (more precisely, length 20*c*) housed therein, and the cable exit slot which has a width smaller than the diameter of the cable 20. The cable guide 28*a* of FIGS. 3 and 5A has a rectangular (or square) cross section, which may be formed of correspondingly shaped stock or alternatively formed of a pair of opposed, facing angle members. The cable guide 28*a* is a generally enclosed structure defining a cable passage interior 34*a* therein, with an interior diameter or dimension 36*a* somewhat larger than the diameter 38 of the cable portion 20*c* passing therethrough, in order to allow the cable 20 to move freely within the cable passage 34 of the guide 28*a*. However, a longitudinal cable exit slot 40*a* is provided, facing toward the center of the elevator shaft 10 and having a width 42*a* less than that of the diameter 38 of the cable length 20*c*, as shown most clearly in the top plan view of FIG. 5A.

Figure 5B:
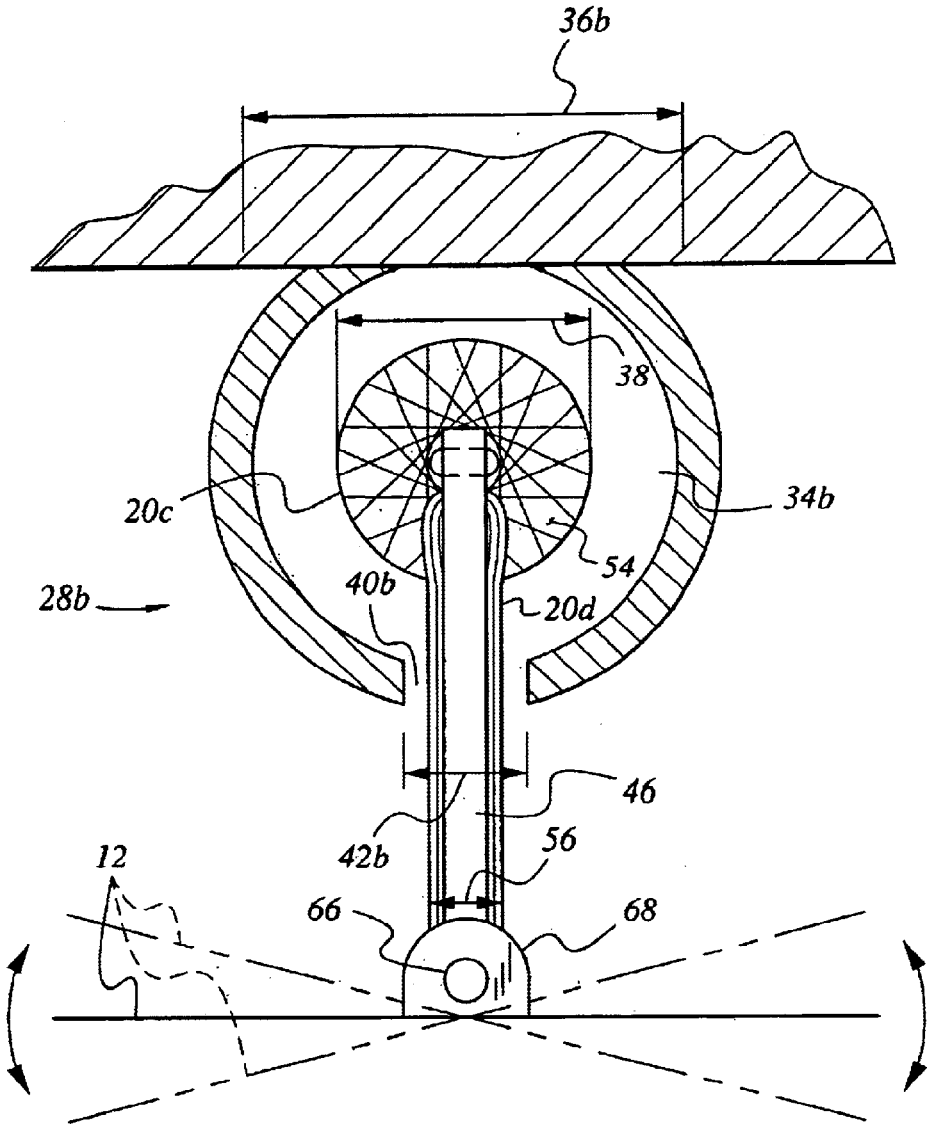
FIG. 5B is a detail top plan view in section, showing a second embodiment cable guide having a circular, oval, or elliptical section.

FIG. 5B illustrates a plan view in section of a second embodiment of the present cable guide, designated as guide 28*b*. The guide 28*b* is a generally enclosed structure defining a cable passage interior 34*b* therein, with an interior diameter or dimension 36*b* somewhat larger than the diameter 38 of the cable portion 20*c* passing therethrough, similarly to the configuration of the cable guide 28*a* of FIGS. 3 and 5A. A longitudinal cable exit slot 40*b* is provided, facing toward the center of the elevator shaft and having a width 42*b* less than that of the diameter 38 of the cable length 20*c*. The distinction between the cable guide 28*a* of FIGS. 3 and 5A and the cable guide 28*b* of FIG. 5B, is that the cable guide 28*b* has a circular (or at least round, e.g., oval, elliptical, etc.) cross section, as opposed to the square or rectangular cross section of the cable guide 28*a* of FIGS. 3 and 5A. It will be seen that the specific cross sectional shape of the cable guide 28 is not critical, so long as the interior provides sufficient room for free movement of the cable 20 therein.

Figure 4A:
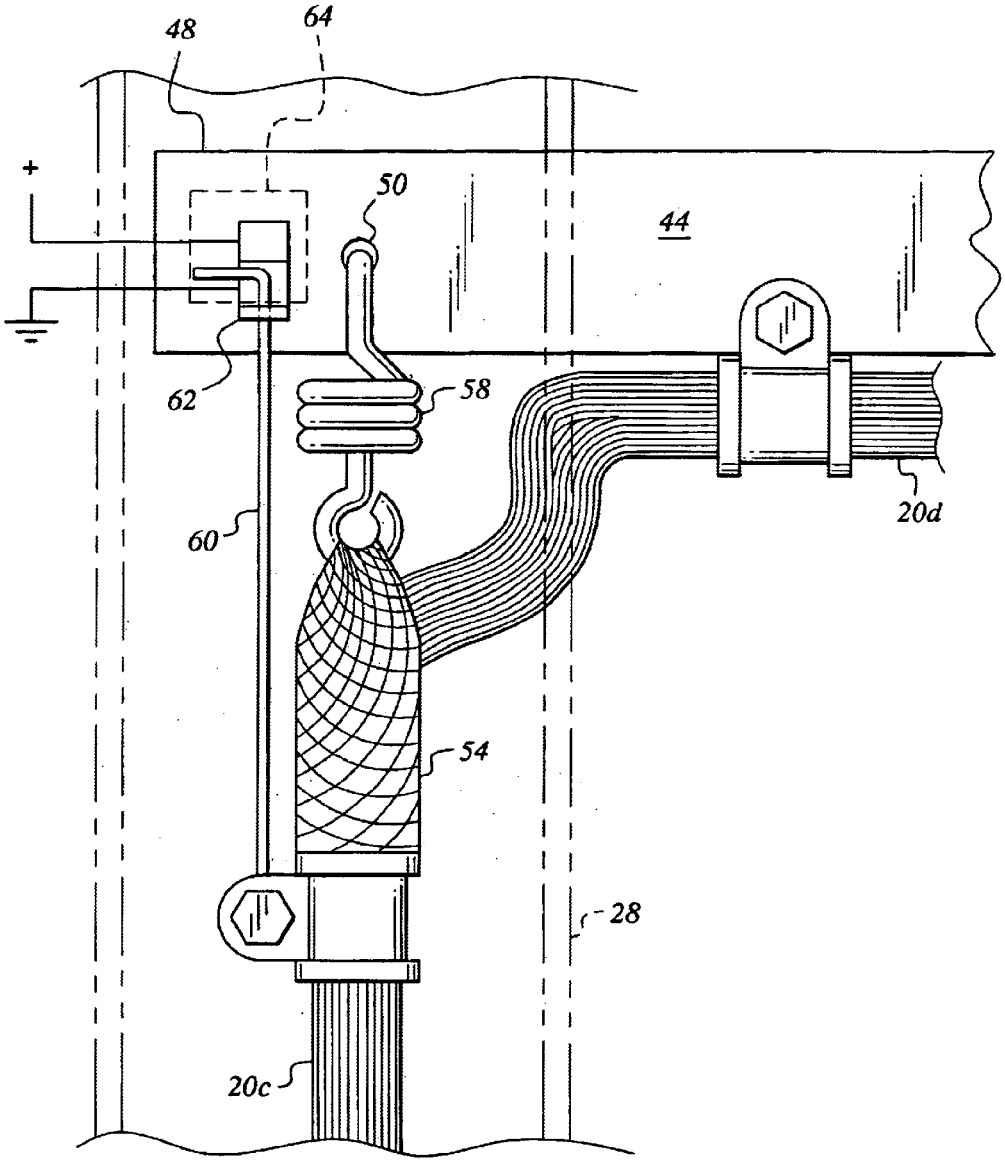
FIG. 4A is a broken away side elevation view of the upper end of a cable of the present system, showing the mechanism for shutting down the system in the event of a cable or reel jam.
Figure 4B:
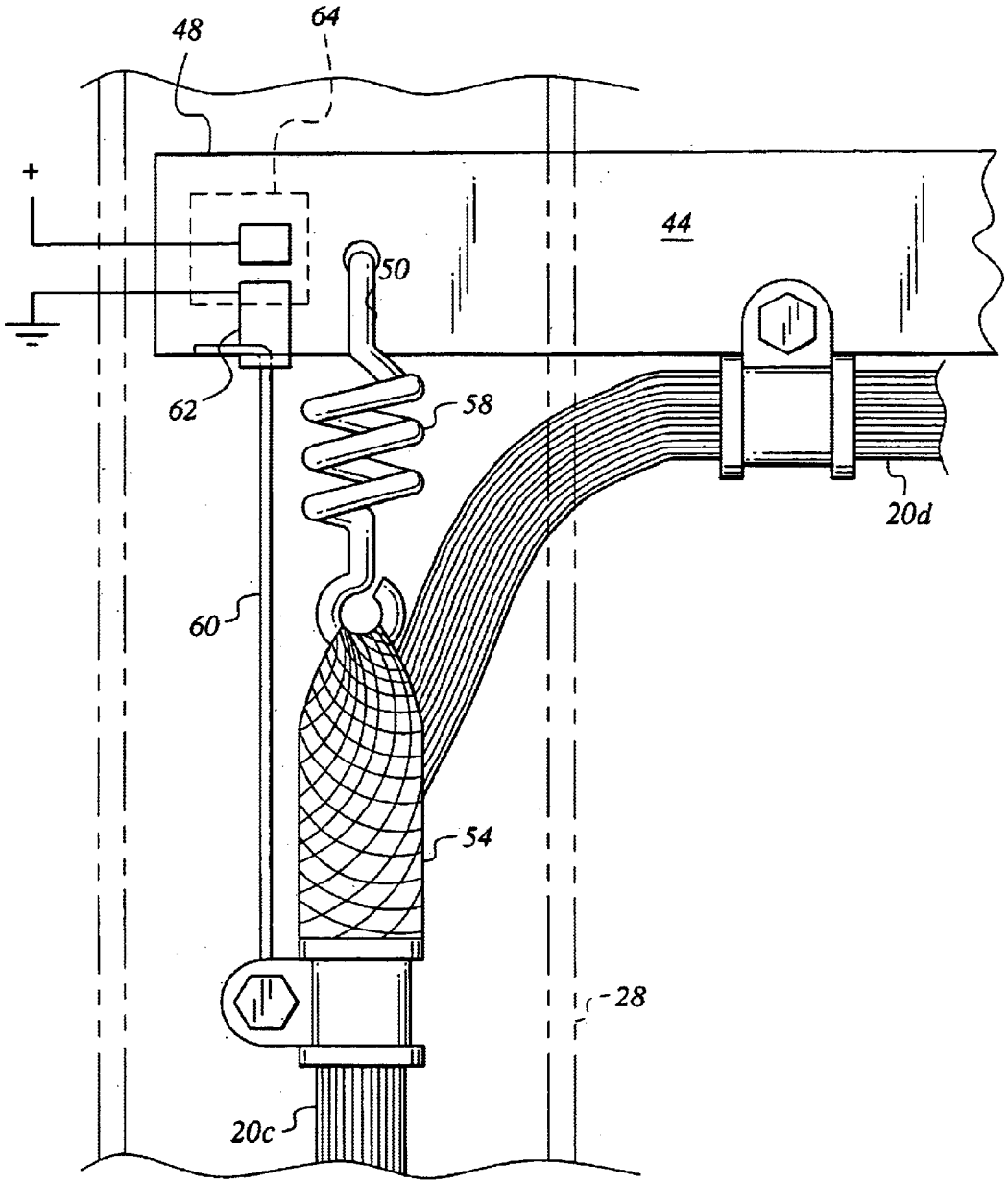
FIG. 4B is a broken away side elevation view of the mechanism of FIG. 4A, showing its operation after a cable or reel jam.

FIGS. 3, 4A, and 4B illustrate the means used to support the cable 20 and guide it to the elevator car 12, with this means being shown generally in the overall view of FIG. 1. A cable lift bar 44 has an elevator car attachment end 46 secured to the elevator car 12, as shown in FIG. 1, with an opposite elevator cable attachment end 48 extending through the longitudinal slot 40*a* (or 40*b*) of the cable guide 28*a* (or 28*b*). The cable attachment end 48 of the cable lift bar 44 includes some means (e.g., hole or passage 50 and attachment ring 52, etc.) to support the cable 20*c*.

The cable section 20*c* running within the cable guide 28*a* (or 28*b*, etc.) has a cable lift bar attachment fitting 54 secured thereto or therearound and extending therefrom, generally as shown in FIGS. 3, 4A, and 4B. This fitting 54 may comprise a woven grip sleeve or the like which is passed around the cable section 20*c* near the upper portion thereof, and which shrinks diametrically to tighten its grip around the cable 20 as tension is applied to the fitting 54. Other cable attachment means may be used as desired. The fitting 54 is secured to the attachment ring 52 (or other attachment means), which is in turn secured to the cable attachment end 48 of the cable lift bar 44, generally as shown in FIG. 3.

The elevator car attachment length 20*d* of the cable 20 which extends beyond the attachment fitting 54 to the elevator car 12 has a somewhat narrower diameter 56 than the diameter 38 of the cable 20 and slot width 42*a* (or 42*b*), in order to pass freely through the longitudinal slot 40*a* (or 40*b*) of the cable guide 28*a* (or 28*b*), as shown in FIGS. 5A and 5B. The wires of the attachment length 20*d* may be stacked vertically beneath the cable lift bar 44, or otherwise arranged to provide a relatively narrow width or diameter 56 to pass through the cable guide slot 40*a* (or 40*b*). The critical point is that the wire bundle of the car attachment length 20*d* be sufficiently narrow to pass freely through the slot 40*a* (or other) of the cable guide 28, whatever its embodiment may be. A protective shield or the like (not shown, for clarity in the drawings) may be provided around the car attachment length 20*d* as it passes through the guide slot 40*a* or 40*b* of the cable guide 20.

The present elevator mechanism operates by controlling the cable takeup and dispensing reel 22 as the elevator car 12 is raised and lowered, to control the amount of cable 20 extending therefrom and to allow sufficient cable output while also preventing excessive cable extension therefrom. This process is controlled by a linear transducer, illustrated schematically in FIG. 6 and discussed further below. However, it will be recognized that if the cable 20 jams or is caught in some manner, and/or if the cable take up and dispensing reel 22 malfunctions, that the cable 20 may be damaged if the elevator car 12 continues to operate. This is of course most critical in the event of a cable stoppage where the elevator car continues to rise, thus risking cable breakage due to excessive tension on the cable.

FIGS. 4A and 4B illustrate a power shutoff switch mechanism to preclude cable damage under such circumstances. In FIGS. 4A and 4B, the fitting 54 holding the upper end of the cable section 20*c* is secured to the cable attachment end 48 of the cable lift bar 44 by a cable support spring 58. The spring 58 provides sufficient tensile force to remain compressed while supporting all of the weight of the cable section 20*c* at the upper level of travel of the elevator car 12 during normal operation. However, in the event that the cable section 20*c* (or other portion of the cable 20 extending from the reel 22) becomes jammed, snagged, or otherwise cannot pay out as the elevator car 12 rises, the additional tensile force on the cable 20*c* will stretch the spring 58, generally as shown in FIG. 4B of the drawings.

The upper portion of the cable 20*c* includes a link 60 (rod, etc.) extending upwardly therefrom, which engages a movable portion 62 of a normally closed switch mechanism 64. This switch 64 controls electrical current to a relay (or equivalent circuit) which is normally closed to allow electrical power to flow to the elevator lift motor 14 (shown in FIG. 1), or other elevator lift power means. Normal operation of this mechanism is illustrated in FIG. 4A of the drawings.

However, in the event the cable 20 becomes jammed or for some reason cannot pay out as the elevator car rises, the spring 58 will extend, as illustrated in FIG. 4B. When this occurs, the upper end of the cable length 20*c* is pulled away somewhat from the cable attachment end 48 of the cable lifting bar 44. However, before damage can occur, the link rod 60 attached to the upper end of the cable length 20*c*, pulls open the movable portion 62 of the elevator shutoff switch 64, thereby shutting off electrical power to the elevator car 12 before the cable 20*c* can be pulled loose from the cable lift bar 44 or otherwise damaged. Once the problem has been corrected, tension is relieved on the cable length 20*c* which allows the spring 58 to retract, thus allowing the normally closed contacts of the shutoff switch 64 to close, restoring power to the elevator system. It will be appreciated that the above described system is exemplary, and that other automated shutoff systems may be provided to protect the control cable 20 and other systems of the present elevator mechanism.

The top plan views in section of FIGS. 5A and 5B illustrate two of a number of different possible cable guide configurations, as noted further above. These two drawing Figs. also illustrate a means of pivotally affixing the cable lift bar 44 to the elevator car 12, to allow the lift bar 44 to maintain its alignment within the cable guide slot 40*a* (or 40*b*, etc.) in the event that the car 12 shifts laterally within the elevator shaft, as shown by the broken line positions of the car 12 wall in FIGS. 5A and 5B. In these drawing Figs., the elevator car attachment end 46 of the cable lift bar 44 is secured to the car 12 by a vertically disposed pivot pin 66, which passes through a pair of lugs or ears 68 (the upper one of which is visible in the drawing Figs.) which extend from the elevator car 12 wall. If the car 12 shifts angularly within the elevator shaft, the pivotal attachment of the cable lifting bar 44 allows the cable lift bar 44 to pivot laterally about the vertically disposed pivot pin 66, thereby allowing the cable attachment end 48 of the bar 44 to maintain the proper alignment through the cable guide slot 40*a* (or 40*b*), to preclude jamming therein and damage to the system.

Figure 6:
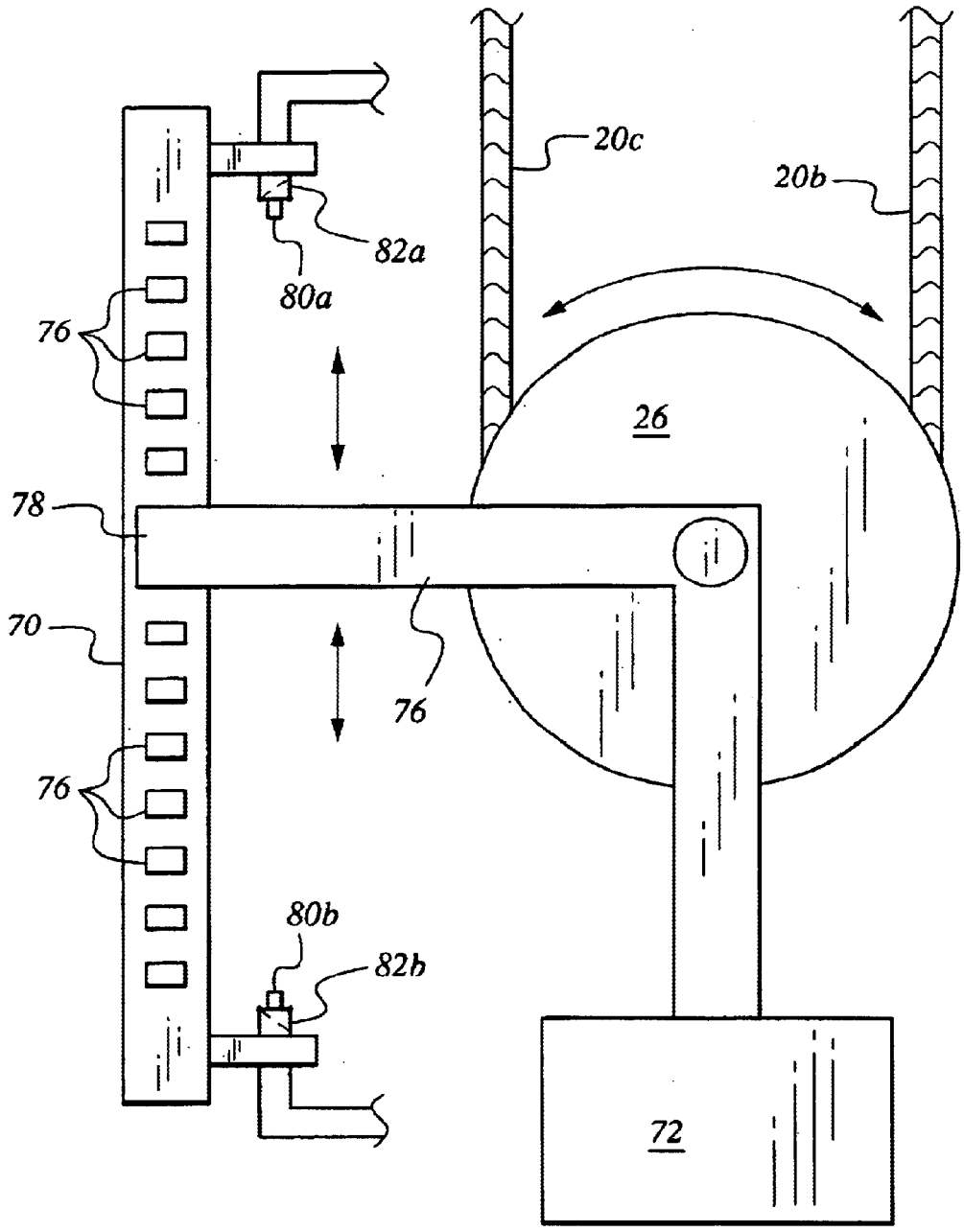
FIG. 6 is a detail side elevation view of a linear transducer for use with the present elevator mechanism, for controlling payout or takeup of the cable on a takeup reel.

The present elevator mechanism also preferably includes some form of control mechanism for the cable dispensing and takeup reel 22, as noted further above. FIG. 6 provides a schematic illustration of an exemplary takeup reel control system, comprising a linear transducer 70. Motion of the slack cable buffer control pulley 26 moves the transducer arm 74, thereby controlling the cable takeup and dispensing reel 22.

The transducer system of FIG. 6 includes a slack cable buffer weight 72 suspended from the slack buffer control pulley 26, with a transducer contact arm 74 extending from the pulley 26 and communicating with the transducer 70. A series of electrical contacts 76 (or a continuous resistance strip, or other equivalent means) is provided along the linear transducer 70, with the contact end 78 of the transducer contact arm 74 communicating with one or more of the contacts 76 as the arm 74 travels upwardly and downwardly with motion of the elevator car 12 and corresponding takeup or payout of the cable 20.

As the elevator car 12 rises, the cable portion 20*c* which extends upwardly into the cable guide 28 will draw the slack cable buffer control pulley 26 upwardly, thus making electrical contact with one or more of the upwardly placed transducer electrical contacts 76. When this occurs, a signal is sent to a motor (not shown, but conventional) operating the cable takeup and dispensing reel 22 to pay out more cable. When cable is dispensed more rapidly than the rise of the elevator car 12 draws the cable length 20*c* upwardly, the transducer arm 78 will drop downwardly, making contact with different transducer contacts 76 to slow the dispensing rate of the takeup and dispensing reel 22. Too slow a dispensing rate will cause the transducer arm 74 to continue to rise, with the contact end 78 of the arm 74 contacting the uppermost electrical contacts 76 which drive the dispensing reel 22 to dispense the cable at a faster rate. Once this is achieved, the transducer contact arm 74 will descend to a generally medial point along the transducer 70, closing contacts 76 which drive the reel 22 at a slower rate.

In the event the elevator car is descending (or the cable is dispensed too rapidly to an ascending elevator car), the weight 72 draws the slack cable buffer control pulley 26 downwardly, below the medial area of the transducer bar 70. When this occurs, the lower transducer contacts 76 make contact with the distal end 78 of the transducer arm 74 to provide a signal to the takeup and dispensing reel 22 to draw in the cable more rapidly. It will be seen that this action is constantly adjusting as the elevator car 12 rises and descends and as its rate of ascent or descent varies, with the linear transducer 70 constantly providing drive signals to the takeup and dispensing reel 22 to keep the cable 20 at its proper length.

In the event of a malfunction of the cable reel 22, the motion of the elevator car 12 will draw the slack cable buffer control pulley 26 and its attached transducer contact arm 74 upwardly to the upper end of the transducer bar 70. If this occurs, an upper switch contact 80*a* is contacted by the transducer contact arm 74, opening a normally closed limit switch 82*a* to shut down the operation of the elevator system, similarly to the shutoff system illustrated in FIGS. 4A and 4B and described further above. In the event that the cable dispensing pulley 22 pays out too much cable, the weight 72 will draw the slack cable buffer control pulley 26 downwardly until the distal end 78 of the arm 74 contacts the lowermost switch contact 80*b*, thereby opening a normally closed limit switch 82*b* to shut down the system. It will be appreciated that equivalent systems may be used in lieu of those described herein, with the electrical wiring system being conventional.

To this point, the present elevator mechanism has been described in controlling the motion and operation of an electrical cable 20, which may include power, control, and/or communications cables in any combination. The operation of the elevator car has been described by means of a mechanical system comprising a rack and pinion mechanism. However, it will be seen that the present elevator mechanism with its cable guide, may also be applied to a mechanical lift cable, in addition to or in lieu of its use with an electrical cable.

Figure 2:
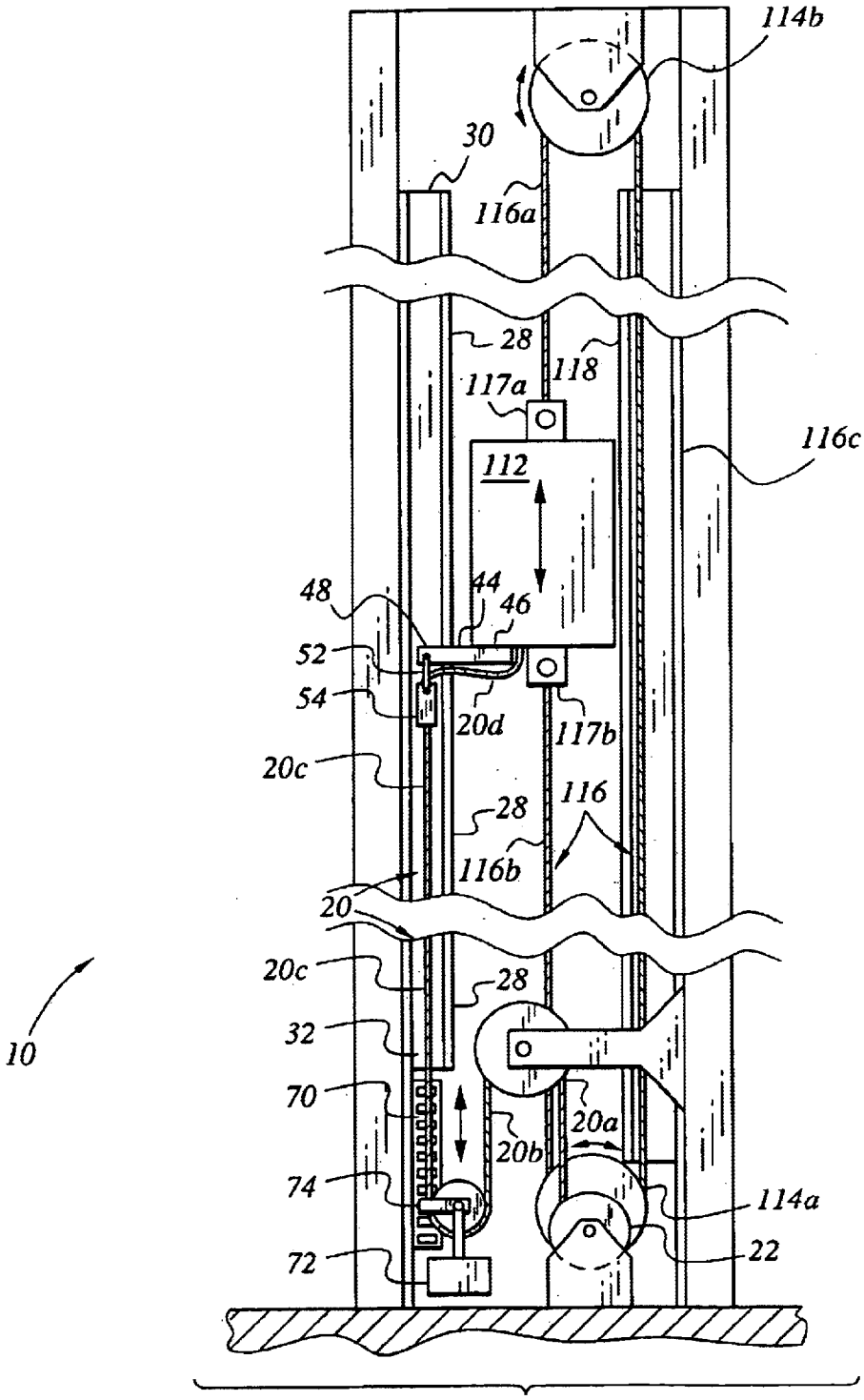
FIG. 2 is an elevation view of a second embodiment comprising a lift cable elevator system incorporating the present elevator mechanism, and showing various features thereof.

FIG. 2 of the drawings provides an illustration of an elevator system utilizing a mechanical cable lift system, in which the lift cable is protected by a cable guide of the present invention. In FIG. 2, the elevator shaft 110 includes an elevator car 112, but the car 112 is operated by a cable system rather than the rack and pinion system shown in FIG. 1. In FIG. 2, a lower lift cable pulley 114*a* is disposed at the bottom of the elevator shaft 110, with an opposite upper lift cable pulley 114*b* positioned at the upper end of the shaft 110. A lift cable 116 extends around the two pulleys 114*a* and 114*b*, with its respective upper and lower portions 116*a* and 116*b* being connected to the elevator car 112 at attach points 117*a* and 117*b*. (Conventional balance weights, idler pulleys, etc. are not shown in FIG. 2, for clarity in the drawing Fig.)

A lift cable guide 118 is provided along one side of the elevator shaft 110, in the manner of the control cable guide 28 shown in FIGS. 1 and 2. The return portion 116*c* of the lift cable 116, i.e., that portion which is not attached to the elevator car 112, passes through the lift cable guide 118, generally in the manner described further above for the operation of the electrical cable guide 28. It will be seen that those lengths 116*a* and 116*b* of the lift cable 116 which secure directly to the elevator car 112, may be routed along the side(s) of the elevator shaft 110, if so desired, and may be attached to one side of the elevator car 112. An additional balance cable system(s) may be provided to the opposite side of the shaft 110, in order to provide equal lifting and support forces for the elevator car 112, if required. In this manner, nearly all of the lifting cable 116 may be housed and protected within a cable guide(s) 118, to preclude damage thereto due to lateral movement due to wind or other forces. The elevator car attachment portions of the cable(s) 116 may be configured to be secured to a laterally disposed lifting bar which extends from the elevator car through the guide slot, in the manner used for carrying the electrical cable 20 and described further above.

Alternatively, upper and lower lift bars may extend from opposite sides of the elevator car and into opposite cable guides disposed along the opposite sides of the elevator shaft, where they connect with the corresponding lift cables running within the two cable guides. It will be recognized that opposed upper and lower lift bars similar to the cable lift bar 44 may be added to the elevator cab 12 of FIG. 2, with a second lift cable provided opposite the lift cable 116 illustrated, to provide the configuration described.

In conclusion, the present elevator mechanism provides much needed protection for cables which may be used in elevator systems. The present elevator mechanism may be adapted to virtually any type of elevator system as desired. However, such protection is particularly important in elevators used in tall, open latticework structures where the wind may blow through the structure and move the cables laterally, and the taller the structure, the more critical this becomes. As a result, most such elevators have been constructed using cable lift systems. Wireless radio has been used for such control and communication, but its drawbacks (possible interference, weak signals due to weak electrical batteries or other causes, etc.) result in less than totally reliable performance from such systems. The present invention finally provides a means of protecting hard wired electrical and mechanical cables, while still allowing the cables to pass from the protective guide to connect with the elevator car. The increase in reliability and reduction in costs provided by the present system in comparison to radio controlled systems, will be greatly appreciated by the industry.

It is to be understood that the present invention is not limited to the embodiments described above, but encompasses any and all embodiments within the scope of the following claims.

I claim:

1. An elevator mechanism for installing within an elevator shaft, with the elevator shaft having a height and containing an elevator car, said mechanism comprising:

at least one substantially vertically disposed cable guide having a lower end, an upper end opposite said lower end, and extending as a continuous component for substantially the height of the elevator shaft;

an elevator cable disposed within said cable guide, with said elevator cable having a diameter;

said cable guide comprising a generally enclosed structure defining a cable passage interior with an interior diameter larger than said diameter of said elevator cable;

said cable guide further including a longitudinal slot formed therein, with said longitudinal slot having a width narrower than said diameter of said elevator cable for retaining said elevator cable within said cable guide;

a cable lift bar having an elevator car attachment end and an elevator cable attachment end opposite said elevator car attachment end;

a cable lift bar attachment fitting disposed upon said elevator cable and extending therefrom, and securing said elevator cable to said elevator cable attachment end of said cable lift bar;

an elevator car attachment length extending from said elevator cable;

said elevator car attachment length of said elevator cable having a width narrower than said width of said longitudinal slot of said cable guide;

said elevator car attachment length of said elevator cable passing through said slot of said cable guide, for connecting to the elevator car; and switch means disposed upon said elevator cable attachment end of said cable lift bar and communicating with said elevator cable, for terminating operation of the elevator when excessive strain occurs upon said elevator cable.

2. The elevator mechanism according to claim 1, wherein said cable guide has a cross section selected from the group consisting of square cross sections, rectangular cross sections, and round cross sections.

3. The elevator mechanism according to claim 1, wherein said elevator cable is an electrical cable.

4. The elevator mechanism according to claim 1, wherein said elevator cable is a lift cable.

5. An elevator mechanism for installing within an elevator shaft, with the elevator shaft having a height and containing an elevator car, said mechanism comprising:

at least one substantially vertically disposed cable guide having a lower end, an upper end opposite said lower end, and extending as a continuous component for substantially the height of the elevator shaft;

an elevator cable disposed within said cable guide, with said elevator cable having a diameter;

said cable guide comprising a generally enclosed structure defining a cable passage interior with an interior diameter larger than said diameter of said elevator cable;

said cable guide further including a longitudinal slot formed therein, with said longitudinal slot having a width narrower than said diameter of said elevator cable for retaining said elevator cable within said cable guide;

a cable lift bar having an elevator car attachment end and an elevator cable attachment end opposite said elevator car attachment end;

a cable lift bar attachment fitting disposed upon said elevator cable and extending therefrom, and securing said elevator cable to said elevator cable attachment end of said cable lift bar;

an elevator car attachment length extending from said elevator cable;

said elevator car attachment length of said elevator cable having a width narrower than said width of said longitudinal slot of said cable guide;

said elevator car attachment length of said elevator cable passing through said slot of said cable guide, for connecting to the elevator car; and means for laterally pivotally attaching said elevator car attachment end of said cable lift bar to the elevator car, for precluding binding of said cable lift bar within said cable guide when the elevator car shifts laterally within the elevator shaft.

6. An elevator mechanism for installing within an elevator shaft, with the elevator shaft having a height and containing an elevator car, said mechanism comprising:

at least one substantially vertically disposed cable guide having a lower end, an upper end opposite said lower end, and extending as a continuous component for substantially the height of the elevator shaft;

an elevator cable disposed within said cable guide, with said elevator cable having a diameter;

said cable guide comprising a generally enclosed structure defining a cable passage interior with an interior diameter larger than said diameter of said elevator cable;

said cable guide further including a longitudinal slot formed therein, with said longitudinal slot having a width narrower than said diameter of said elevator cable for retaining said elevator cable within said cable guide;

an elevator cable takeup reel; and a linear transducer communicating mechanically with said elevator cable and electrically with said elevator cable take up reel, for controlling said elevator cable takeup reel as the elevator car moves within the elevator shaft.

7. The elevator mechanism according to claim 6, further including upper and lower limit switches disposed upon said linear transducer, for terminating operation of the elevator car when said elevator cable takeup reel or said elevator cable becomes jammed.

8. The elevator mechanism according to claim 6, further including:

a series of electrical contacts disposed along said linear transducer;

a contact arm having one end communicating with said linear transducer and an opposite end;

a slack cable buffer control pulley positioned at the opposite end of said contact arm; and a weight suspended from said slack cable buffer control pulley;

whereby, motion of the slack cable buffer control pulley moves the contact arm along the series of electrical contacts of the linear transducer, thereby controlling the elevator cable takeup reel as the elevator car moves within the elevator shaft.

9. An elevator shaft having a height and containing an elevator car therein and an elevator mechanism therefor, comprising in combination:

at least one cable guide disposed substantially vertically within said elevator shaft;

said cable guide having a lower end, an upper end opposite said lower end, and extending as a continuous component for substantially said height of said elevator shaft;

an elevator cable disposed within said cable guide, with said elevator cable having a diameter;

said cable guide comprising a generally enclosed structure defining a cable passage interior with an interior diameter larger than said diameter of said elevator cable;

said cable guide further including a longitudinal slot formed therein, with said longitudinal slot having a width narrower than said diameter of said elevator cable for retaining said elevator cable within said cable guide;

a cable lift bar having an elevator car attachment end secured to said elevator car, and an elevator cable attachment end opposite said elevator car attachment end;

a cable lift bar attachment fitting disposed upon said elevator cable and extending therefrom, and securing said elevator cable to said elevator cable attachment end of said cable lift bar;

an elevator car attachment length extending from said elevator cable;

said elevator car attachment length of said elevator cable having a width narrower than said width of said longitudinal slot of said cable guide;

said elevator car attachment length of said elevator cable passing through said slot of said cable guide, for connecting to said elevator car; and switch means disposed upon said elevator cable attachment end of said cable lift bar and communicating with said elevator cable, for terminating operation of said elevator car when excessive strain occurs upon said elevator cable.

10. The elevator shaft, elevator car, and elevator mechanism combination according to claim 9, further including means for laterally pivotally attaching said elevator car attachment end of said cable lift bar to said elevator car, for precluding binding of said cable lift bar within said cable guide when said elevator car shifts laterally within said elevator shaft.

11. An elevator shaft having a height and containing an elevator car therein, and an elevator mechanism therefor, comprising in combination:

at least one cable guide disposed substantially vertically within said elevator shaft;

said cable guide having a lower end, an upper end opposite said lower end, and extending as a continuous component for substantially said height of said elevator shaft;

an elevator cable disposed within said cable guide, with said elevator cable having a diameter;

said cable guide comprising a generally enclosed structure defining a cable passage interior with an interior diameter larger than said diameter of said elevator cable;

said cable guide further including a longitudinal slot formed therein, with said longitudinal slot having a width narrower than said diameter of said elevator cable for retaining said elevator cable within said cable guide;

an elevator cable takeup reel; and a linear transducer communicating mechanically with said elevator cable and electrically with said elevator cable take up reel, for controlling said elevator cable takeup reel as said elevator car moves within said elevator shaft.

12. The elevator shaft, elevator car, and elevator mechanism combination according to claim 11, further including:

a series of electrical contacts disposed along said linear transducer;

a contact arm having one end communicating with said linear transducer and an opposite end;

a slack cable buffer control pulley positioned at the opposite end of said contact arm; and a weight suspended from said slack cable buffer control pulley;

whereby, motion of the slack cable buffer control pulley moves the contact arm along the series of electrical contacts of the linear transducer, thereby controlling the elevator cable takeup reel as the elevator car moves within the elevator shaft.

13. The elevator shaft, elevator car, and elevator mechanism combination according to claim 11, further including:

a lift cable for driving said elevator car; and a lift cable guide disposed within said elevator shaft and housing a portion of said lift cable therein.

14. The elevator shaft, elevator car, and elevator mechanism combination according to claim 11, further including a rack and pinion lift for driving said elevator car.

15. The elevator shaft, elevator car, and elevator mechanism combination according to claim 11, further including upper and lower limit switches disposed upon said linear transducer, for terminating, operation of said elevator car when said elevator cable takeup reel or said elevator cable becomes jammed.

16. The elevator shaft, elevator car, and elevator mechanism combination according to claim 11, wherein said cable guide has a cross section selected from the group consisting of square cross sections, rectangular cross sections, and round cross sections.

17. The elevator shaft, elevator car, and elevator mechanism combination according to claim 11, wherein said elevator cable is an electrical cable.

18. The elevator shaft, elevator car, and elevator mechanism combination according to claim 11, wherein said elevator cable is a lift cable.

* * * * *